United States Patent [19]

Deschaaf

[11] 4,132,008

[45] Jan. 2, 1979

[54] CONTROL CIRCUIT FOR DRIER

[75] Inventor: Clifford L. Deschaaf, Stevensville, Mich.

[73] Assignee: Whirlpool Corporation, Benton Harbor, Mich.

[21] Appl. No.: 803,344

[22] Filed: Jun. 3, 1977

[51] Int. Cl.[2] ..... F26B 11/04

[52] U.S. Cl. ..... 34/45; 34/53; 34/89; 219/506

[58] Field of Search ..... 34/45, 89, 53, 133; 219/506

[56] References Cited

U.S. PATENT DOCUMENTS

| | | | |
|---|---|---|---|
| 3,218,730 | 11/1965 | Menk et al. | 34/89 |
| 3,234,449 | 2/1966 | Lang et al. | 34/89 |
| 3,391,467 | 7/1968 | Miller et al. | 34/45 |
| 3,398,460 | 8/1968 | Elders | 34/45 |
| 3,398,462 | 8/1968 | Harter | 34/45 |
| 3,783,529 | 1/1974 | Muller et al. | 34/45 |

*Primary Examiner*—John J. Camby
*Assistant Examiner*—Larry I. Schwartz
*Attorney, Agent, or Firm*—Wegner, Stellman, McCord, Wiles & Wood

[57] ABSTRACT

A control circuit for a drier wherein a buzzer is provided for signalling termination of the normal drying cycle or operation of the drier in an anti-wrinkle cycle. When utilized to signal the end of a normal cycle, the buzzer provides a short time duration signal and when utilized to indicate the operation of the drier in the anti-wrinkle cycle, the buzzer provides a longer duration signal at periodic intervals during the cycle. Control of the buzzer is by a single cycle switch connected in cooperation with a timed switch for controlling operation of the drier drive motor, and a centrifugal switch also provided for controlling operation of the drier drive motor. The cycle switch may be a double throw switch and may have an associated pulser mechanism for effecting the desired intermittent operation of the buzzer for indicating the anti-wrinkle cycle.

12 Claims, 2 Drawing Figures

FIG. 1
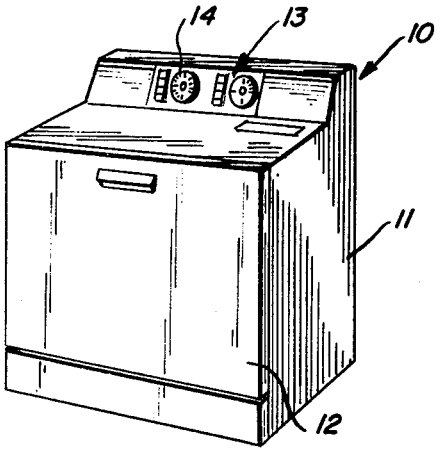
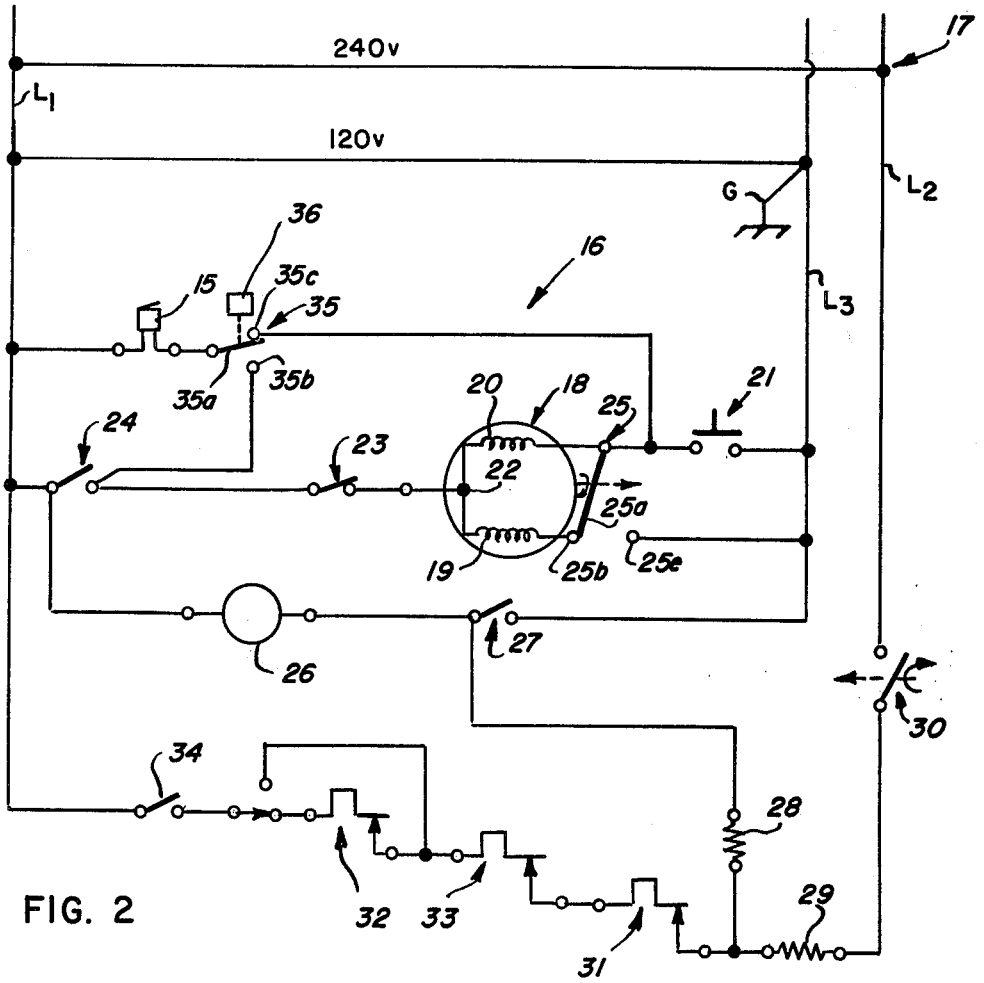
FIG. 2

CONTROL CIRCUIT FOR DRIER

BACKGROUND OF THE INVENTION

1. Field of the Invention

This invention relates to a drier apparatus and in particular to circuitry for controlling a signal device in connection with the operation of drier apparatus.

2. Description of the Prior Art

In U.S. Pat. Nos. 3,365,809 of Donald F. Eppley, 3,391,467 of Samuel J. Miller, et al., 3,398,460 of Alvin J. Elders, and 3,491,458 of Alvin J. Elders et al., each of which patents is owned by the assignee hereof, a number of different drier control circuits are shown for use with clothes driers having an anti-wrinkle cycle.

Additional clothes drier controls are disclosed in other U.S. Patents, such as No. 2,796,679 of Robert L. Dunkelman, No. 3,333,345 of James L. Miller, No. 3,363,326 of Edwin R. Weeks, No. 3,399,461 of Roger F. Doty, No. 3,710,138 of Curran D. Cotton, and No. 3,783,529 of James L. Miller et al.

In Miller U.S. Pat. No. 3,333,345, the drier control circuit includes a buzzer controlled by a centrifugal switch of the drier motor. At the conclusion of the heated drying portion of the drier operation, a brief buzzer signal is produced when the drum temperature drops to a preselected level, with the signal being continued until the drive motor speed is reduced to a preselected low speed.

In the Miller et al. U.S. Pat. No. 3,783,529, a buzzer is connected to be energized at the conclusion of any selected cycle of operation of the drier whenever the door is closed and intermittently during the duration of a no-heat portion at the end of a cycle. Manually operable switch means are provided for controlling the operation of the buzzer circuit as desired.

SUMMARY OF THE INVENTION

The present invention comprehends an improved control circuit for use in a drier apparatus or the like, wherein selective energization of a buzzer is effected by a cycle switch causing the buzzer to operate selectively in series with the drive motor or in parallel therewith to provide different indications of the operation of the drier.

More specifically, the invention comprehends providing such an improved control circuitry wherein the cycle switch comprises a double throw switch arranged to connect the buzzer selectively in series with the drive motor and centrifugal switch and in parallel with a timed switch for normally controlling operation of the drive motor whereby de-energization of the drive motor by opening of the timed switch permits the buzzer to operate until the drive motor speed is reduced to a preselected level whereat the centrifugal switch is thrown from its normal high speed operating arrangement.

Further more specifically, the cycle switch may be selectively disposed to connect the buzzer in series with the centrifugal switch and in parallel with the series connected timed switch and drive motor whereby a pulser associated with the cycle switch may cause an intermittent operation of the buzzer as during the anti-wrinkle drying cycle.

The timer motor may be connected across the power supply so as to be operable independently of the drive motor.

The control circuit of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a drier apparatus having a control circuit embodying the invention; and FIG. 2 is a schematic wiring diagram of the control circuit.

DESCRIPTION OF THE PREFERRED EMBODIMENT

In the exemplary embodiment of the invention as disclosed in the drawing, a drier apparatus generally designated 10 illustratively comprises a floor-mounted domestic-type clothes drier having a cabinet 11 provided with a front door 12 for front loading of clothes to be dried in the drier. The drier may include a control console 13 provided with suitable manually operable control elements, such as elements 14, for selectively controlling the operation of the drier in different modes.

As discussed briefly above, the invention herein is concerned with the provision of a signal for indicating to the user different conditions of operation of the drier. More specifically, the invention comprehends the provision of signal means, which may be in the form of a signal device such as buzzer 15, for providing an audible signal to indicate to the user (a) the termination of a normal drying cycle and (b) the operation of the drier in a preselected anti-wrinkle cycle. The signal provided by the buzzer to indicate the two different conditions may be correspondingly different so as to advise the user specifically of the different conditions.

More specifically as shown in FIG. 2, the drier control generally designated 16 is arranged to be connected to a three-wire power supply generally designated 17 having high voltage leads L1 and L2 and a neutral lead L3 defining, with lead L1, a low voltage supply. In the illustrated embodiment, the voltage between leads L1 and L2 is 240 volts and the voltage between leads L1 and L3 is 120 volts. The neutral lead L3 may be suitably grounded, as shown at G.

The drier has drive means including a drive motor 18 for rotating the drier drum (not shown). The drive motor may be provided with a conventional start winding 19 and a run winding 20. A momentary switch such as push-to-start rotary switch 21 is connected from power supply lead L3 to the run winding 20. A common connection 22 between the start and run windings is connected through a door switch 23 and a timed switch 24 to power supply lead L1. In the "off" condition of the drier, the switch 24 may be closed so that initiation of operation of the drier may be effected by the manual closing of switch 21 thereby establishing a circuit from power supply lead L1 through closed switch 24, closed door switch 23, the parallel connection of start winding 19 and run winding 20, and switch 21 to power supply lead L3. The run and start windings are connected in parallel at this time by a centrifgal switch generally designated 25 having a moving contact **25*a* selectively engageable with a first fixed contact 25*b* connected to start winding 19, and a second fixed contact 25*c* connected to power supply lead L3. Thus, when the drive motor is stationary, or running at a speed less than a preselected speed, the centrifugal switch is connected as shown in FIG. 2 to connect start winding 19 in parallel with run winding 20 through switch 21** to power supply lead L3.

When, however, the speed of the drive motor increases to beyond the preselected speed, moving contact *25a* of the centrifugal switch is thrown from fixed contact *25b* to fixed contact *25c*, thereby disconnecting the start winding 19 and causing the motor to continue to run solely on the run winding 20. Such continued operation is maintained notwithstanding the release of switch 21 as the centrifugal switch now serves as a holding switch connected in parallel around the start switch 21.

The switch 24 enables operation of the motor 18 during the drier cycle and terminates motor operation at the conclusion of the cycle. The switch 24, as shown in FIG. 2, is a timed switch and is controlled by a timer motor 26, which is connected through a timed switch 27 in series relationship between power supply leads L1 and L3.

As further shown in FIG. 2, the timer motor is connected in series with a resistor 28 and the drier heater 29 to a second centrifugal switch 30 connected to power supply lead L2.

In parallel with the series connection of timer motor 26 and resistor 28 is a series of thermostat switches, including a safety thermostat switch 31, and a pair of operating thermostat switches 32 and 33. In series with the thermostat switches is another timed switch 34 operated by the timer 26.

As indicated briefly above, the invention is concerned with the control of buzzer 15 so as to provide different signals to the user corresponding to different operating conditions of the drier. As shown in FIG. 2, the control includes switch means including a cycle switch generally designated 35 for providing this desirable control of the operation of buzzer 15. The cycle switch comprises herein a single pole, double throw switch having a moving contact *35a* connected to the buzzer 15, a first fixed contact *35b* connected to the switch 24, and a second fixed contact *35c* connected to the switch 21. The cycle switch may be manually set in either a first or second operation mode to select either a normal cycle by throwing movable contact *35a* into contact with fixed contact *35b*, or an anti-wrinkle cycle by throwing movable contact *35a* into an electrically engageable relationship with fixed contact *35c*. When thrown into engagement with fixed contact *35b*, the moving contact *35a* is maintained in engagement therewith during the entire drying cycle. When thrown into the engageable relationship with fixed contact *35c*, the moving contact *35a* is caused to intermittently make and break the connection; and, for this purpose, a pulser means which may be a conventional pulser mechanism generally designated 36 is provided. In the illustrated embodiment, the pulser mechanism causes the moving contact *35a* to close with fixed contact *35c* for about seven seconds at the end of approximately the first 8½ minutes of the anti-wrinkle cycle and at 5-minute intervals thereafter during the remainder of the anti-wrinkle cycle which may be, for example, 30 minutes in duration.

Thus, it can be seen that when the cycle switch 35 is arranged to engage moving contact *35a* with fixed contact *35b*, the buzzer is connected in parallel with timed switch 24 and is effectively shorted out by the timed switch when the timed switch is closed to energize the drive motor 18. Thus, during the normal drying cycle, the buzzer remains unenergized. However, upon completion of the drying cycle timed switch 24 opens so as to no longer short out the buzzer and thereby permit the buzzer to be energized in series with the motor run winding 20 through the centrifugal switch contact *25a* closed with fixed contact *25c*. This causes energization of the buzzer as the impedance of the buzzer is substantially higher than that of the run winding 20 so that only the buzzer will be effectively energized under this operating condition.

The energization of the buzzer at this time continues until the coasting motor slows down to the preselected speed at which the centrifugal switch 25 is thrown back to the position where contact *25a* is closed into contact *25b*, thereby breaking the circuit to power supply lead L3 from the buzzer and discontinuing further production of the buzzer signal. In the conventional drier, such reduction in the motor speed occurs in approximately two to three seconds and, thus, the signal produced by the buzzer to indicate the termination of the normal drying cycle is a signal of approximately two to three seconds duration.

When the cycle switch is set for anti-wrinkle operation with the moving contact *35a* engageable with fixed contact *35c*, a circuit is completed from the buzzer 15 through the centrifugal switch 25 to power supply lead L3 at all times during such closed condition of the switch 35. However, the pulser mechanism 36 permits such closed arrangement only at preselected intervals during the anti-wrinkle cycle, and thus the buzzer is energized intermittently during that cycle.

In the illustrated embodiment, the pulser mechanism effects the engagement of moving contact *35a* with fixed contact *35c* at the end of approximately 8½ minutes of operation of the drier in the anti-wrinkle mode and at the subsequent 5-minute intervals discussed above.

Under this condition, the buzzer is connected in parallel with the series connection of the timed switch 24 and motor winding 20 and, thus, operation of the buzzer is controlled by the operation of the pulser mechanism 36.

A highly desirable feature of the invention is the energization of the buzzer accurately at the termination of the normal drying cycle as such operation is effected without the need for control cams or the like controlling the buzzer, but rather, is controlled concurrently by the same timed switch that controls the operation of the drive motor. Thus, the operation of the buzzer is automatically accurately correlated with the termination of drive motor operation since the buzzer signal is initiated when timed switch 24 opens and terminated when centrifugal switch 25 operates from its run to its start condition.

The same cycle switch is utilized in combination with the pulser mechanism to provide the additional desirable anti-wrinkle cycle indicating means and the use of the same single pole, double throw switch to effect each of these two different signal operations provides an improved low cost structure for this purpose.

The normal drive motor timed control switch and the normal drive motor centrifugal switch are utilized in conjunction with the cycle switch in a novel manner to provide the highly desirable functioning described above by the alternative connection of the buzzer in series with the drive motor or in parallel therewith depending on the setting of the cycle switch.

It should be understood that although the invention has been described in the context of a 240-volt electric drier, the invention could be utilized equally well with a gas drier or a 120-volt electric drier.

The foregoing disclosure of specific embodiments is illustrative of the broad inventive concepts comprehended by the invention.

The embodiments of the invention in which an exclusive property or privilege is claimed are defined as follows:

1. In a drier apparatus having a drum drive motor for operation from an electrical power supply, a timer having a timed switch for providing a timed power circuit connection from said power supply to said drive motor, and a centrifugal switch for providing a power circuit connection of the drive motor to the power supply when the drive motor is rotating above a preselected speed, with said timed switch, said drive motor, and said centrifugal switch connected in series across said power supply, the improvement comprising:

a buzzer;

a first switch means for selectively connecting said buzzer in parallel with said timed switch only;

a second switch means for selectively connecting said buzzer in parallel with said series connected timed switch, drive motor, and centrifugal switch; and means for selectively connecting said buzzer through said first and second switch means whereby said buzzer is operated during operation of the drive motor whenever said second switch means is disposed to connect said buzzer in parallel with said series connected timed switch, drive motor, and centrifugal switch with the drive motor operating above said preselected speed, and is operated whenever said first switch means is disposed to connect said buzzer in parallel with said timed switch upon disconnection of said drive motor by said timed switch at the end of a drive motor operating cycle and until the motor slows to said preselected speed.

2. The drier apparatus of claim 1 wherein means are provided for causing said second switch to be operated intermittently when selectively controlling operation of said buzzer.

3. The drier apparatus of claim 1 wherein said timer includes a timer motor connected in parallel with said series connected timed switch, drive motor and centrifugal switch.

4. The drier apparatus of claim 1 further including a pulser means for causing said second switch means to operate said buzzer intermittently.

5. The drier apparatus of claim 1 further including a pulser means for causing said second switch means to operate said buzzer for approximately seven seconds every five minutes.

6. The drier apparatus of claim 1 wherein said timer includes a timer motor connected to the power supply for operation independently of the operation of the drive motor.

7. The drier apparatus of claim 1 wherein said buzzer has an impedance substantially greater than that of said drive motor whereby said buzzer will operate and said drive motor will not operate when said timed switch disconnects said drive motor and said first switch means connects said buzzer in series with said drive motor and centrifugal switch with the motor coasting above said preselected speed.

8. The drier apparatus of claim 1 wherein the duration of operation of said buzzer as controlled by said first switch is different from the duration of operation of said buzzer as controlled by said second switch.

9. In a drier apparatus having a drum drive motor for operation from an electrical power supply, a timer having a timed switch for providing a timed power circuit connection from said power supply to said drive motor, and a centrifugal switch for providing a power circuit connection of the drive motor to the power supply when the drive motor is rotating above a preselected speed, with said timed switch, said drive motor, and said centrifugal switch connected in series across said power supply, the improvement comprising:

a buzzer;

a first switch means for selectively connecting said buzzer in parallel with said timed switch only;

a second switch means for selectively connecting said buzzer in parallel with said series connected timed switch, drive motor, and centrifugal switch; and means for selectively connecting said buzzer through said first and second switch means whereby said buzzer is operated during operation of the drive motor whenever said second switch means is disposed to connect said buzzer in parallel with said series connected timed switch, drive motor, and centrifugal switch with the drive motor operating above said preselected speed, and is operated whenever said first switch means is disposed to connect said buzzer in parallel with said timed switch upon disconnection of said drive motor by said timed switch at the end of a drive motor operating cycle and until the motor slows to said preselected speed, said first and second switch means being defined by a single pole, double throw switch having a moving contact connected to said buzzer, a first fixed contact connected to between said timed switch and said drive motor, and a second fixed contact connected to between said drive motor and said power supply.

10. In a drier apparatus having a drum drive motor for operation from an electrical power supply, a timer having a timed switch for providing a timed power circuit connection from said power supply to said drive motor, and a centrifugal switch for providing a power circuit connection of the drive motor to the power supply when the drive motor is rotating above a preselected speed, with said timed switch, said drive motor, and said centrifugal switch connected in series across said power supply, the improvement comprising:

a buzzer;

a first switch means for selectively connecting said buzzer in parallel with said timed switch only;

a second switch means for selectively connecting said buzzer in parallel with said series connected timed switch, drive motor, and centrifugal switch; and means for selectively connecting said buzzer through said first and second switch means whereby said buzzer is operated during operation of the drive motor whenever said second switch means is disposed to connect said buzzer in parallel with said series connected timed switch, drive motor, and centrifugal switch with the drive motor operating above said preselected speed, and is operated whenever said first switch means is disposed to connect said buzzer in parallel with said timed switch upon disconnection of said drive motor by said timed switch at the end of a drive motor operating cycle and until the motor slows to said preselected speed, said first and second switch means comprising a double throw switch.

11. In a drier operable through a cycle and having a motor for operation from an electrical power supply including first and second power leads, a centrifugal switch operated by the motor and connecting said motor to said second lead only when said motor is operating above a predetermined speed, a motor control switch connected between said motor and said first lead for enabling operation of said motor throughout said cycle and terminating said motor operation at the conclusion of said cycle, improved signal means comprising:

a signal device for providing a signal, switch means for selectively connecting said signal device in first and second operating modes, said signal device in said first mode being connected across said motor control switch only, and said signal device in said second mode connectable across the combination of said switch and said motor, and pulser means acting on said switch means in said second mode for intermittently causing the connection of said signal device across said combination, whereby in said first mode a signal is produced when said switch terminates said motor operation and continued until said motor operation drops below said predetermined speed, and in said second mode a signal is produced each time said pulser means places said signal device across said combination while said motor is operating above said predetermined speed.

12. In a fabric drier having first and second power leads connectable to a power supply, a rotatable fabric receptacle, drive means including a motor for driving said receptacle, a momentary switch for electrically connecting said motor momentarily to said second power lead to initiate operation of said motor, a centrifugal switch operated by said motor and electrically connected between said motor and said second power lead for shunting said momentary switch when and only when said motor is operating above a predetermined speed, timer means electrically connected across said first and second power leads, and a timed switch controlled by said timer means and electrically connecting said motor to said first power lead for enabling motor operation during a drier cycle and terminating motor operation at the conclusion of said cycle, improved buzzer means comprising:

a buzzer for generating an audible signal, cycle switch means for selectively connecting said buzzer in first and second operating modes, said buzzer in said first mode electrically connected across said timed switch only, and said buzzer in said second mode electrically connectable across the series combination of said timed switch and said motor, and pulser means acting on said cycle switch means in said second mode for intermittently causing and connection for predetermined intervals of said buzzer across said series combination of said timed switch and said motor.

* * * * *